US007571980B2

(12) United States Patent
Deshon-Stepp et al.

(10) Patent No.: US 7,571,980 B2
(45) Date of Patent: Aug. 11, 2009

(54) CLEANING METHOD AND APPARATUS FOR A PRINTHEAD ASSEMBLY

(75) Inventors: Pamela R. Deshon-Stepp, Canby, OR (US); James M. Cunnington, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 727 days.

(21) Appl. No.: 11/296,144

(22) Filed: Dec. 7, 2005

(65) Prior Publication Data

US 2007/0126783 A1 Jun. 7, 2007

(51) Int. Cl.
*B41J 2/165* (2006.01)

(52) U.S. Cl. ..... 347/30; 347/31; 347/32; 347/33

(58) Field of Classification Search ..... None
See application file for complete search history.

(56) References Cited

U.S. PATENT DOCUMENTS 5,372,852 A 12/1994 Titterington et al.
5,555,461 A 9/1996 Ackerman
5,570,117 A * 10/1996 Karambelas et al. ..... 347/33
5,786,830 A * 7/1998 Su et al. ..... 347/33
6,155,667 A * 12/2000 Eckard et al. ..... 347/33
6,764,160 B1 7/2004 Phillips et al.
6,783,221 B2 8/2004 Phillips
2005/0122374 A1* 6/2005 Lim et al. ..... 347/33

* cited by examiner

*Primary Examiner*—Duy-Vu N Deo
(74) *Attorney, Agent, or Firm*—Maginot, Moore & Beck

(57) ABSTRACT

A method and apparatus are provided for cleaning a first set and a second set of a staggered full-width array printhead assembly (SFWA) in an inkjet printer. The apparatus for the method includes (a) a wiper blade carriage assembly (WBCA) having a wiper blade unit at a first set point; (b) a timing belt and a stepper motor assembly for moving the WBCA between a home position and a number of operating positions; (c) devices for moving the first and second sets of printheads between resting positions and a wiping positions; (d) computer programs for controlling movements (i) of the WBCA from the home position into wiping contact with, and past, the first and second sets of printheads in first and second wiping positions respectively, (ii) of the first and second sets of printheads out of the wiping positions, and (iii) of the WBCA from the wiping positions back to the home position; and (e) apparatus for horizontally moving and re-aligning the wiper blade unit on the WBCA at a second set point for wiping the second set of printheads.

9 Claims, 8 Drawing Sheets

CLEANING METHOD AND APPARATUS FOR A PRINTHEAD ASSEMBLY

This disclosure relates generally to image producing machines such as copiers, printers, facsimile machines and the like which use marking material delivery printheads, and more particularly to a cleaning method and apparatus for use in such machine, for example a phase change ink machine, to clean a printhead assembly. The phase change ink printhead cleaning apparatus for example is disclosed in a phase change ink image producing machine or printer using same.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them to the image receiving substrate, and fixing the phase change ink to the substrate.

Ordinarily, phase change ink printers of this kind have only one printhead that can be cleaned by wiping the face thereof vertically with an elastomeric blade. However, when a similar printer includes two upper printheads and two lower printheads comprising an assembly of four offset printheads, the arrangement of such printheads presents a challenge of being able to wipe all of the printheads clean while not allowing waste ink from the upper printheads to contaminate the lower printheads. Prior attempts for cleaning printheads in such printers are disclosed for example in the following references.

U.S. Pat. No. 5,555,461 issued on Sep. 10, 1996 and entitled "Self cleaning wiper blade for cleaning nozzle faces of ink jet printheads" discloses a self cleaning wiper blade cleaning system which has at least one polyurethane wiping blade releasably mounted in a slot on a planar surface of a fixed structural member. A front end of the mounted blade wipes the nozzle face of the printhead as it enters and leaves a priming station to maintain the printhead nozzle face clear of ink and other debris. The ink which is removed from the printhead nozzle face by the edge of the wiper blade is drawn away therefrom by capillary action of small grooves cut in the wiper blade. The grooves have one end in contact with an absorbent pad provided at a bottom edge of the wiper blade and the other end of the slot is adjacent but spaced a predetermined distance from the front edge of the wiper blade. The capillary action of the grooves provides continuous removal of the ink.

U.S. Pat. No. 5,570,117 issued Oct. 29, 1996 and entitled "Print head maintenance method and apparatus with retractable wiper" discloses a method and an apparatus for cleaning an ink jet print head that draw contaminate from orifices in the print head onto an orifice plate and then wipe the orifice plate. The maintenance apparatus includes a purge cap that has a recessed region with an open end. The topside margins of the open end define a periphery around which a seal is positioned. A positioning system urges the orifice plate against the seal. A heating system and a vacuum system cooperate to create a differential pressure across the orifices to draw contaminates carried by liquid ink out of them and onto the orifice plate. A resilient wiper assembly including a spring-mounted wiper blade is positioned in and nominally extends outwardly of the recessed region of the purge cap. The positioning system moves the purge cap downwardly against the orifice plate so that the wiper blade engages and wipes the contamination from the orifice plate.

U.S. Pat. No. 6,783,221 issued Aug. 31, 2004 and entitled "Phase change waste ink control apparatus and method" discloses phase change waste ink control apparatus that are suitable for use in a phase change ink image producing machine including a printhead system. The apparatus for the method includes (a) devices for producing phase change waste ink such as from a printhead system; (b) a waste ink gutter assembly, including a heating device, for collecting, accumulating and coalescing the phase change waste ink. The apparatus also includes (c) a controller for periodically turning the heating device on to heat and melt coalesced phase change waste ink within the waste ink gutter assembly; and (d) a waste ink collection container for collecting melted phase change waste ink from the waste ink gutter assembly.

U.S. Pat. No. 6,764,160 issued Jul. 20, 2004 and entitled "Printhead cleaning apparatus and image producing machine having same" discloses a printhead cleaning method and apparatus for maintaining a printhead assembly within a relatively tight space in an image producing machine. The printhead cleaning apparatus for the method includes (a) at least a first home position adjacent a first side of four sides of an operating zone between a printhead assembly and an imaging surface in the image producing machine; (b) a first moving device for moving the printhead assembly from a printing first position adjacent the imaging surface to a maintaining second position spaced further away from the printing first position; (c) a maintenance apparatus movably supported for movement along an maintenance path interposed between the imaging surface and the printhead assembly; (d) a second moving device for moving the maintenance apparatus for contacting and maintaining the printhead assembly, and along the maintenance path from the at least first home position to a resting position adjacent a second side and opposite the first side of the four sides of the operating zone; and (e) a third moving device for moving the printhead assembly back from the maintaining second position to the printing first position.

In accordance with the present disclosure, there is provided a method and apparatus for cleaning a first set and a second set of a staggered full-width array printhead assembly (SFWA) in an inkjet printer. The apparatus for the method includes (a) a wiper blade carriage assembly (WBCA) having a wiper blade unit at a first set point; (b) a timing belt and a stepper motor assembly for moving the WBCA between a home position and a number of operating positions; (c) devices for moving the first and second sets of printheads between resting positions and a wiping positions; (d) computer programs for controlling movements (i) of the WBCA from the home position into wiping contact with, and past, the first and second sets of printheads in first and second wiping positions respectively, (ii) of the first and second sets of printheads out of the wiping positions, and (iii) of the WBCA from the wiping positions back to the home position; and (e) apparatus for horizontally moving and re-aligning the wiper blade unit on the WBCA at a second set point for wiping the second set of printheads.

Figure 2:
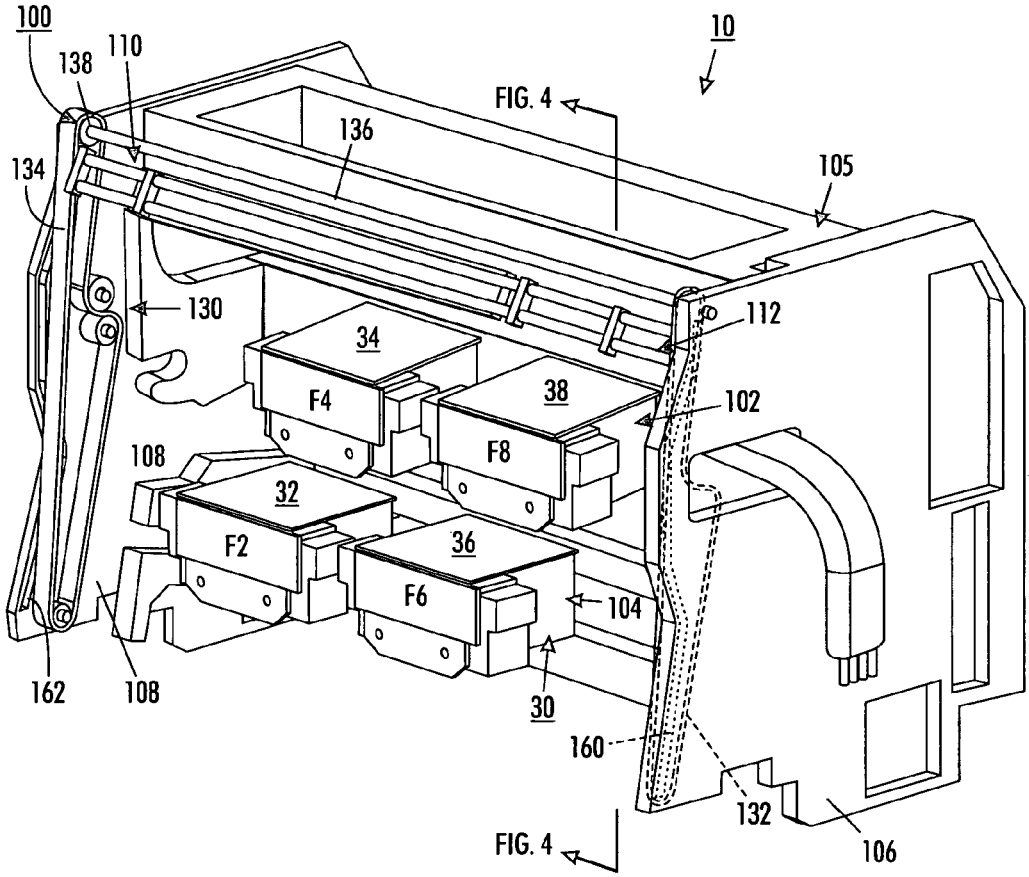
FIG. 2 is a perspective illustration of the printhead cleaning apparatus for the method as employed in the machine of FIG. 1.
Figure 3:
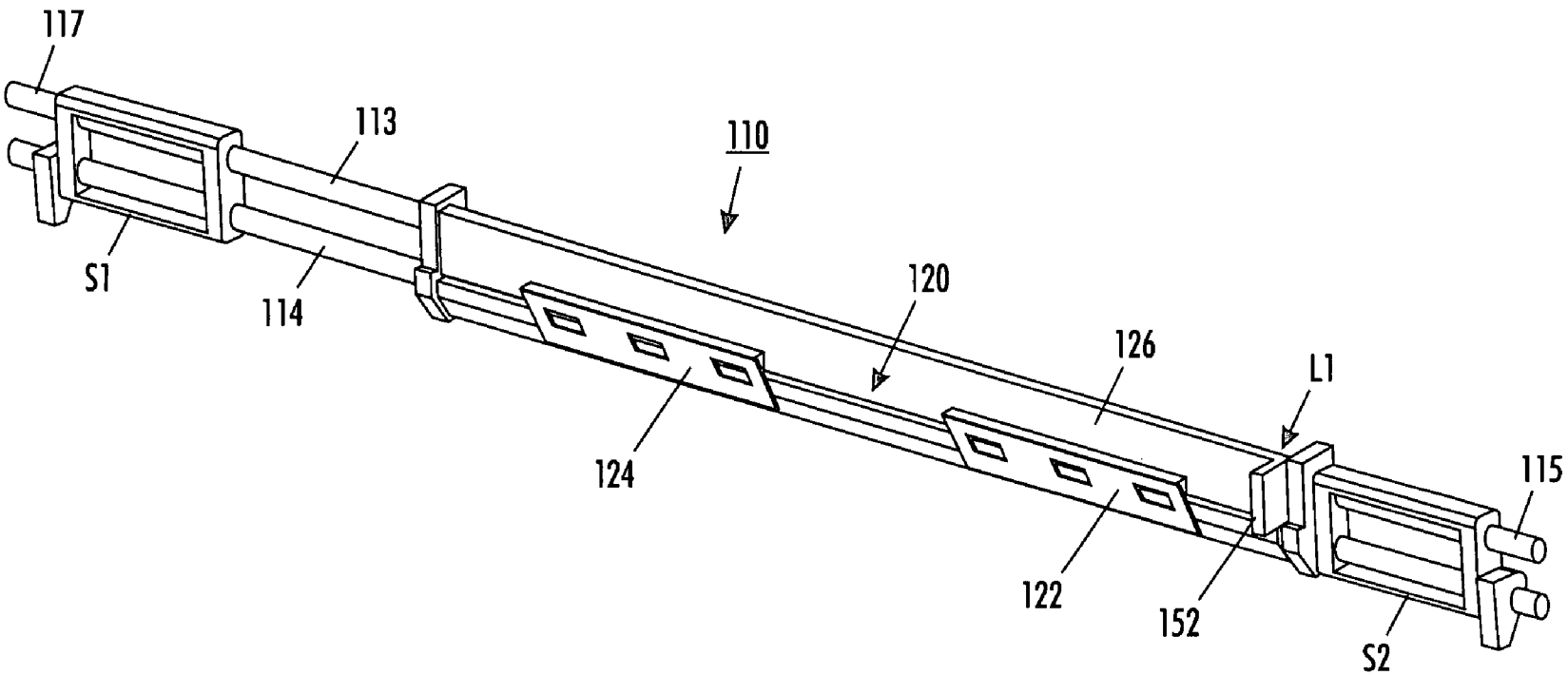
FIG. 3 is an enlarged perspective illustration of the wiper carriage assembly of the printhead cleaning apparatus of FIG. 2 in accordance with the present disclosure.
Figure 4:
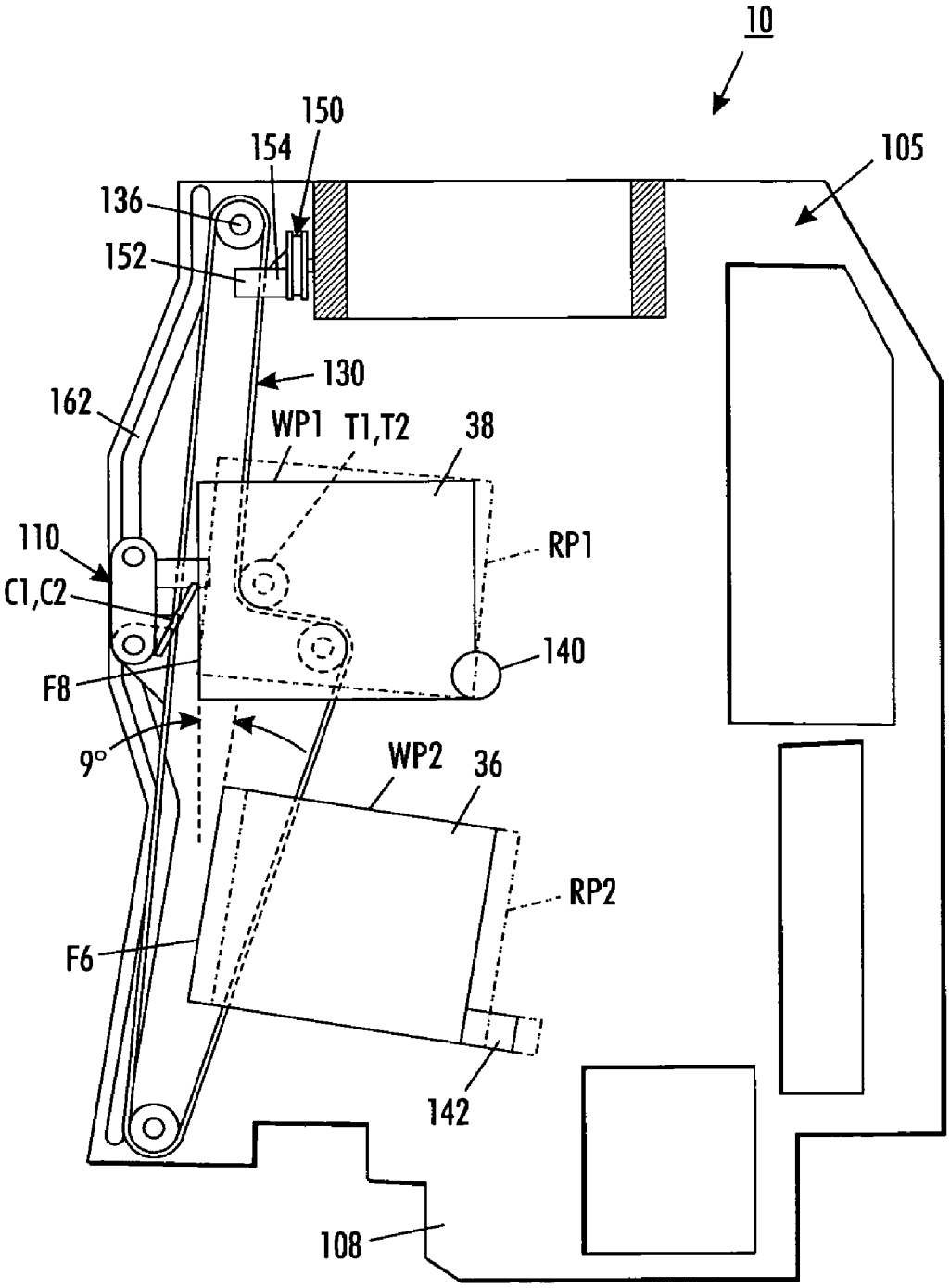
FIG. 4 is a side view along the view plane as shown in FIG. 2.
Figure 5:
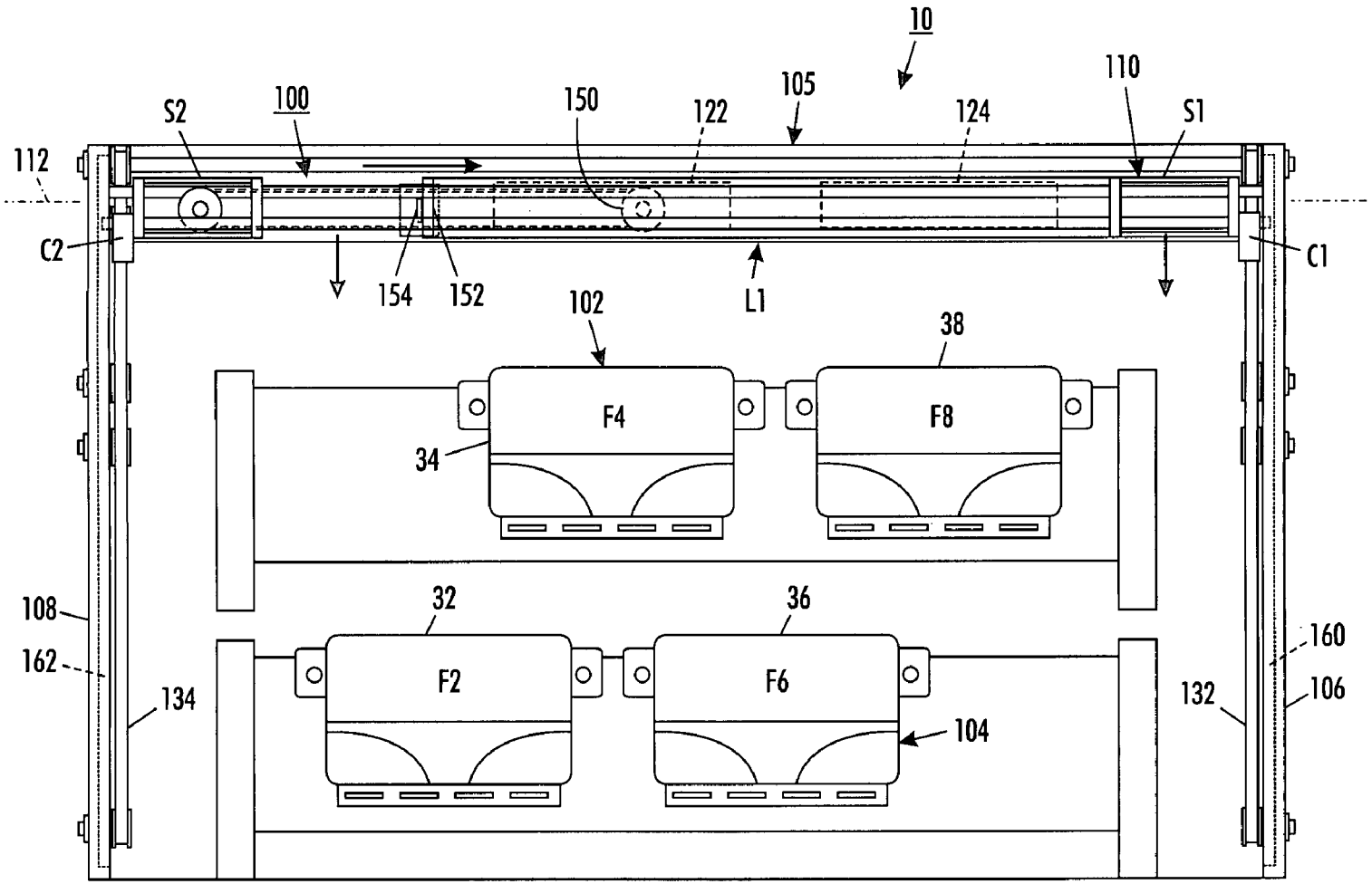
FIG. 5 is a front view of FIG. 2 with the wiper carriage assembly in home position and aligned for cleaning the upper printheads.
Figure 6:
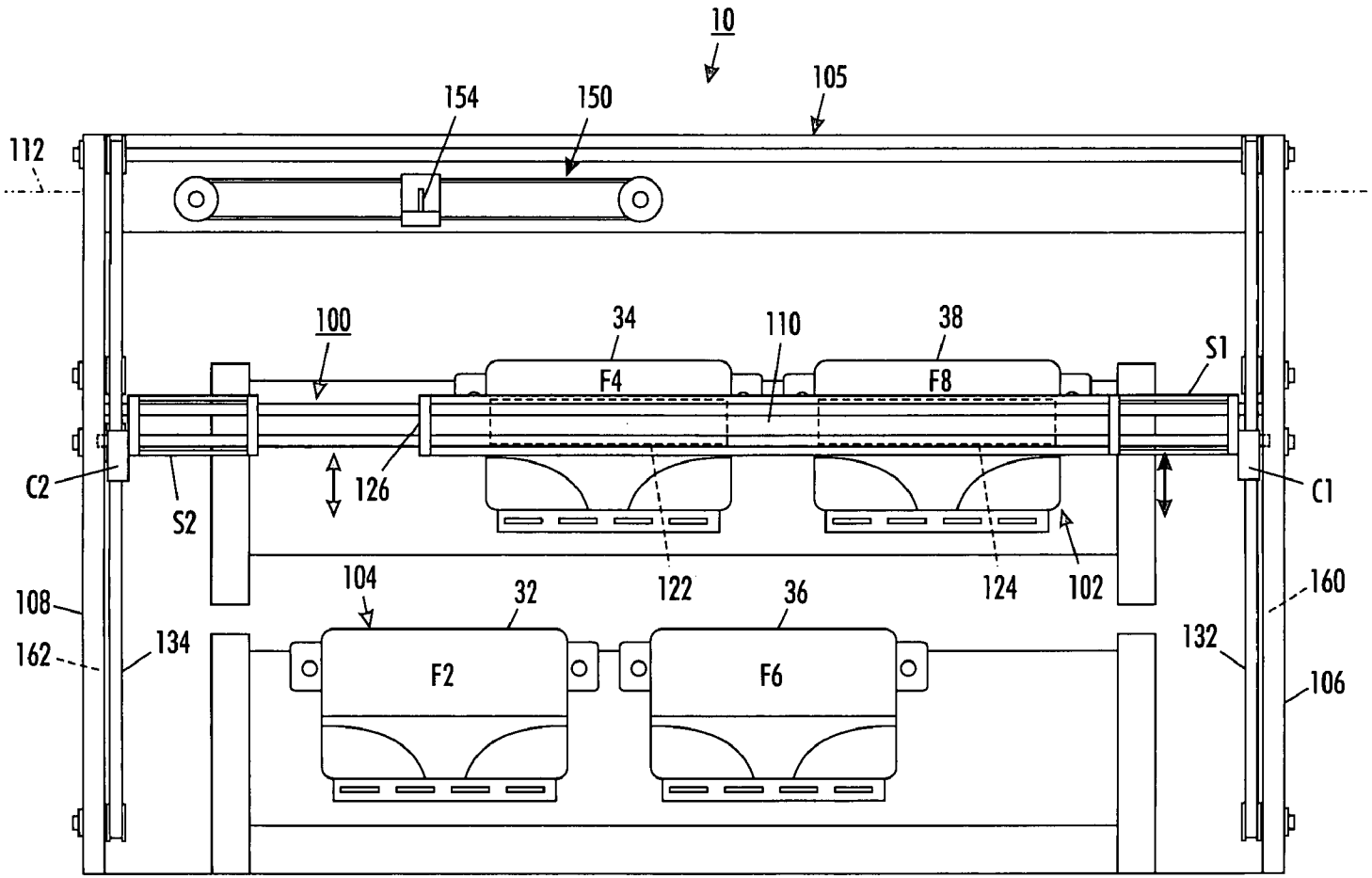
Figure 7:
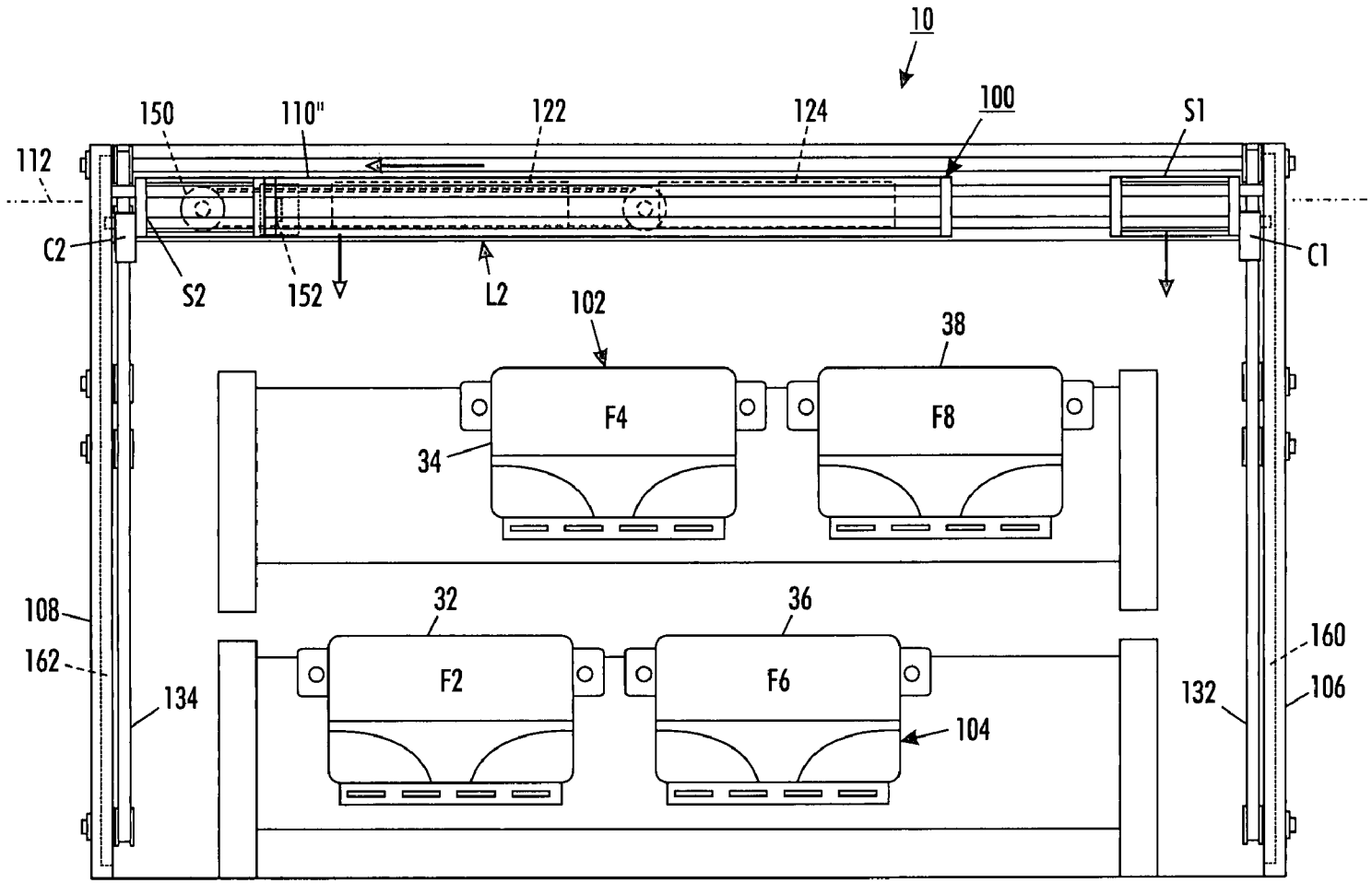
Figure 8:
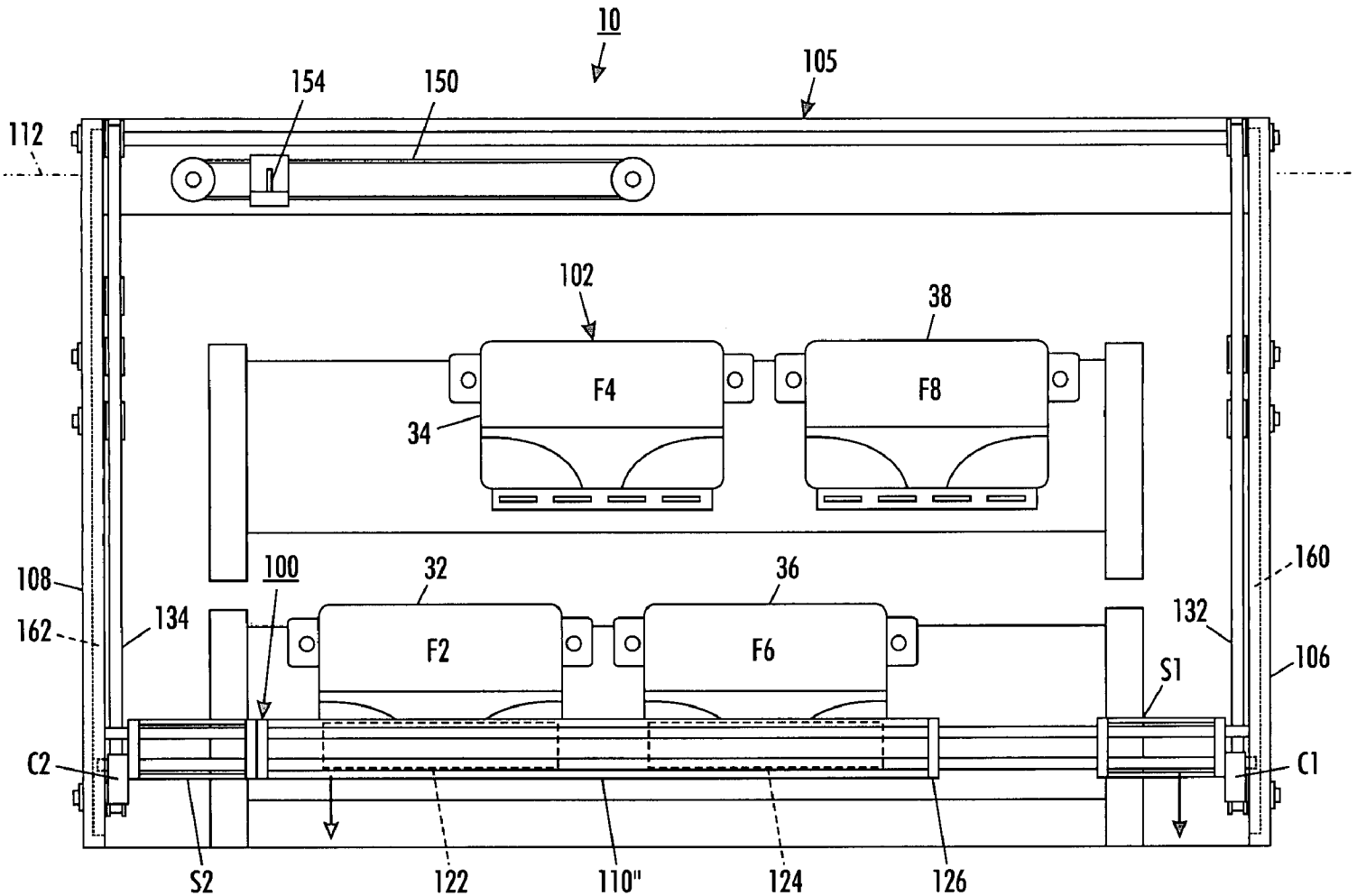

FIG. 6 the same as FIG. 5 with the wiper carriage assembly in the midst of cleaning the upper printheads in accordance with the present disclosure;

FIG. 7 is a front view of FIG. 2 with the wiper carriage assembly in home position and aligned for cleaning the lower printheads; and FIG. 8 is the same as FIG. 7 with the wiper carriage assembly in the midst of cleaning the lower printheads in accordance with the present disclosure.

Figure 1:
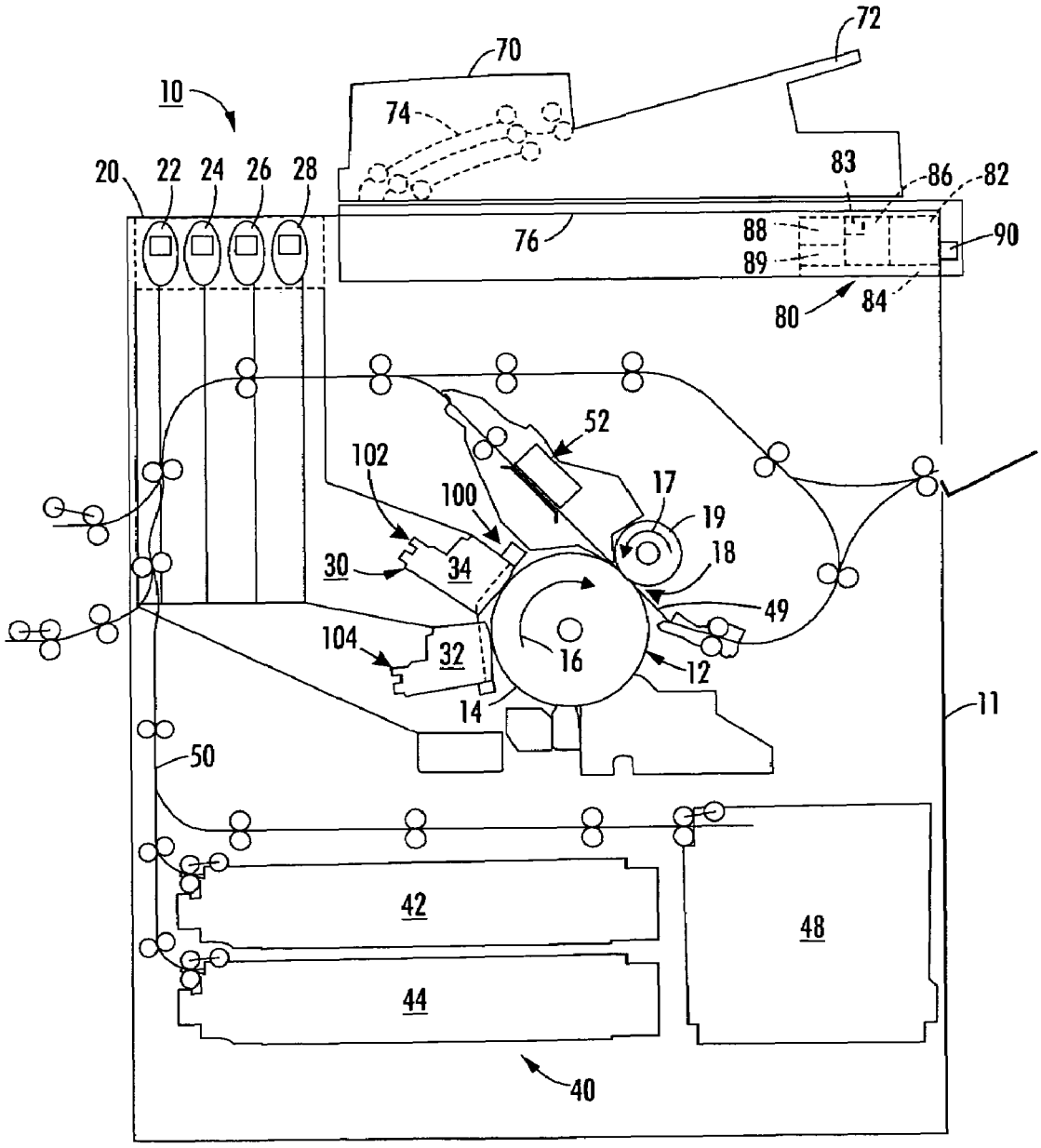
FIG. 1 is a vertical schematic of an image producing machine in the form of an exemplary phase change ink image producing machine including the printhead cleaning method and apparatus of the present disclosure.

Referring now to FIG. 1, there is illustrated an image producing machine, such as a high-speed phase change ink image producing machine or printer 10 of the present disclosure. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a heated copy sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36 and 38 as shown. In order to achieve and maintain relatively high quality image productions by the printhead assembly.

As further shown, the phase change ink image producing machine or printer 10 includes a substrate supply and handling system 40. The substrate supply and handling system 40 for example may include sheet or substrate supply sources 42, 44, 46, 48, of which supply source 48 for example is a high capacity paper supply or feeder for storing and supplying image receiving substrates in the form of cut sheets 49 for example. The substrate supply and handling system 40 also includes a substrate or sheet heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the printhead cleaning apparatus and method 100 of the present disclosure.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred from the surface 14 and fixedly fused to the copy sheet within the transfix nip 18.

Referring now to FIGS. 1-8, the present disclosure is directed to a method and apparatus 100 for cleaning a first set 102 and a second set 104 of a staggered full-width array printhead assembly (SFWA) 30 in the inkjet printer or machine 10. As shown, the printhead cleaning apparatus 100 for the method broadly includes (a) a wiper blade carriage assembly (WBCA) 110 having a wiper blade unit 120 located at a first set point L1 and including wiper blades 122, 124 for wiping the first set 102 of upper printheads 34, 38; (b) a timing belt drive assembly 130 coupled to the WBCA 110 for moving the WBCA between a home position 112 and a number of operating positions WP1, WP2; (c) devices 140, 142 for moving the first set 102 and the second set 104 of printheads between resting positions RP1, RP2 therefore and wiping positions WP1, WP2; (d) computer programs 83 for controlling movements (i) of the WBCA 110 from the home position 112 into wiping contact with, and past, the first set 102 and the second set 104 of the printheads 30 in first and second wiping positions WP1, WP2 respectively, (ii) of the first set 102 and the second set 104 of printheads, out of the first and second wiping positions respectively, and (iii) of the WBCA from the first and second wiping positions back to the home position 112; and (e) translating apparatus 150 for horizontally moving and re-aligning the wiper blade unit 120 on the WBCA at a second set point L2 for wiping the second set 104 of printheads 32, 36.

More specifically, the printhead cleaning apparatus 100 comprises the wiper blade carriage assembly 110 that includes an upper shaft 113 and a lower shaft 114. The wiper blade unit 120 comprises a pair of elastomeric blades 122, 124 attached to a wiper carriage 126 that is slidably movable on the upper shaft 113 and the lower shaft 114 of the WBCA 110. As attached, the wiper blades 122, 124 are spaced apart laterally on the wiper carriage 126 so as to be properly aligned with a pair of the staggered printheads 30.

The printhead cleaning apparatus 100 also comprises printhead moving means or devices 140, 142; vertical motion drive belts 132, 134 and wiper tracks 160, 162 formed into the front edges of plates 106, 108 of the frame 105 to the marking unit of the printer or machine 10. The wiper tracks 160, 162, as such act to direct and constrain the vertical motion of the wiper blade carriage assembly 110 so that the wiper blades 122, 124 move parallel to the front faces F2, F4, F6, F8 of the printheads 32, 34, 36, 38, when the printheads are in their maintenance or wiping positions WP1, WP2. The ends 115, 117 of the wiper blade carriage assembly 110 are insertable removably into the wiper tracks 160, 162, and the lower shaft 114 of the wiper blade carriage assembly 110 is clipped to the vertical motion drive belts 132, 134. When the wiper blade carriage assembly 110 is in its home position 112 at the top of the wiper tracks 160, 162, a first paddle 152 on the wiper blade carriage assembly 110 is in position to mate with a second paddle 154 that is attached to the translation cable apparatus or assembly 150 on the machine marking unit frame 105. The wiper blade unit 120, and hence the wiper blades 122, 124 can thus be moved laterally from one set point L1 to another L2 where they are aligned with the upper first set 102 of the printheads or with the lower second set 104 of the printheads. As pointed out above, the wiper blade unit 120 comprises two wiper blades 122, 124 that are attached to a wiper carriage 126 that is slidable on the shafts 113, 114 of the wiper blade carriage assembly 110, and each wiper blade 122, 124 is used at different times to wipe two (one upper and one lower) printheads 34, 32 for example.

The wiper tracks 160, 162 are molded into the front edges (as shown) of the side plates 106, 108 of the marking unit frame 105. Each of the timing belts 132, 134 includes an active tensioner T1, T2 on the inboard and outboard side plates 106, 108 respectively. Each timing belt 132, 134 is driven by a drive shaft 135, 136 respectively that is run off a stepper motor 138 attached to the inboard side plate 106. The wiper blade carriage assembly 110 is attached to the timing belts 132, 134 via belt clips C1, C2 that are free to pivot about the lower shaft 114 of the wiper blade carriage assembly 110 so as to allow the wiper blade carriage assembly 110 to move smoothly through the curves in the vertical wiper tracks 160, 162.

The wiper carriage 126 of the wiper blade unit 120 is free to slide on the upper and lower shafts 113, 114 of the wiper blade carriage assembly 110 from the first alignment position or set point L1 above the upper or first set 102 of printheads 34, 38, to the second alignment position or set point L2 above the lower or second set 104 of printheads 32, 36. The first and second alignment positions L1, L2 are defined by a stop S1, S2 at either of the two ends of the shafts 113, 114 for positioning the wiper carriage and hence the wiper blades 122, 124 in alignment with the upper printheads 34, 38 towards one end of the shafts, and with the lower printheads 32, 36 towards the other end of the shafts.

To clean the upper or first set 102 of the printheads 34, 38, the orifices or nozzles of the printheads of the first set 102 are first purged. Such purging takes place with the printheads 34, 38 of the first set in their rest position RP1, and with the wiper blade carriage assembly 110 in its home position 112 above the printheads 34, 38. After such purging, the printheads 34, 38 of the first set 102 are moved, for example rotatably, from the resting position RP1 into the first wiping position WP1. The timing drive belts 132, 134 under the control of the controller 80 and programs 83, then moves the wiper blade carriage assembly 110 from the home position 112 (above the printheads and at the top of the wiper tracks) down into wiping engagement between the front surfaces F4, F8 of the printheads 34, 38 of the first set 102 and the wiper blades 122, 124 on the wiper blade carriage assembly 110. When the top-to-bottom wiping of such surfaces is completed, the upper printheads 34, 38 of the first set are retracted, for example rotatably, from the first wiping position WP1 back to their resting position RP1, and the timing drive belts 132, 134 then reverse and move the wiper blade carriage assembly 110 back up to the home position 112 at the top of the wiper tracks 160, 162.

To clean the lower or second set 104 of the printheads 32, 36, the wiper carriage 126 of wiper blade unit 120, and hence the wiper blades 122, 124, are moved horizontally by the apparatus 150 on the upper and lower shafts 113, 114 of the carriage assembly 110 while it is in its home position 112, and re-aligned thereon at L2 for wiping the staggered second set 104 of the printheads 32, 36. To move the wiper carriage 126 horizontally as such, a first means for example the first paddle 152 on the wiper blade carriage assembly 110 is mated with a moving second means such as a second paddle 154 on a movable cable apparatus 150 for translating the wiper carriage 126, and hence the wiper blades 122, 124. The result is a newly configured wiper blade carriage assembly we will reference as WCBA" suitable for cleaning the lower printheads.

Alternatively, the first and second means for translating the wiper carriage 126 could instead comprise gear arrangements or a lead screw arrangement as are well known. For example, the translation motion of the wiper carriage between the first set point L1, and the second set point L2 on the upper and lower shafts 113, 114 can also be accomplished for example with a lead screw (not shown) that mates with a projecting member such as the first paddle on the wiper blade carriage assembly 110. Any suitable gear arrangement that can be selectively coupled under the control of the controller 80 can equally be used to achieve such translation or movement.

With the printheads 32, 36 of the second set 104 still in their rest position RP2, and the wiper carriage 126 with blades 122, 124, re-aligned as above, the orifices or nozzles of the printheads 32, 36 of the second set 104 are then purged next. After that, the printheads 32, 36 of the second set 104 are moved, for example horizontally, from their resting position RP2 into the second wiping position WP2. The timing drive belts 132, 134 under the control of the controller 80 and programs 83, then again move the wiper blade carriage assembly (WBCA") 110" (with the wiper carriage 126 and blades 122, 124 thereon in the re-aligned second set point L2) from the home position 112 (above the printheads and at the top of the wiper tracks) down into wiping engagement between the front surfaces F2, F6 of the printheads 32, 36 of the second set 104 and the wiper blades 122, 124 on the wiper blade carriage assembly 110". When the top-to-bottom wiping of such surfaces is completed, the printheads 32, 36 of the second set 104 are retracted, for example horizontally, from the second wiping position WP2 back to their resting position RP2, and the timing drive belts 132, 134 then again reverse and move the wiper blade carriage assembly 110" back up to the home position 112.

The printhead cleaning apparatus 100 as such is relatively compact and yet allows the wiper blades 122, 124 to be moved (i) about 300 mm vertically between the home position 112 and the bottom of the lower printheads 32, 36 of the second set 104 of printheads, (ii) about 40 mm towards the print drum 14 in their vertical travel through the contoured tracks 160, 162, and (iii) about 75 mm in being moved horizontally between the first and second set points L1, L2 on the shafts 113, 114 of the wiper blade carriage assembly 110.

Advantages of the printhead cleaning method and apparatus 100 include (a) relatively short movements of the printheads 30, within their usual moving paths between a printing position right against the imaging drum surface 14 and their resting position RP1, RP2, and (b) a far cheaper and less critical movement of the wiper blades 122, 124 to the staggered first and second sets 102, 104 of the printheads 30. In other words, a relatively less accurate and therefore less expensive motion by a timing drive belt is used to move the wiper blade carriage assembly 110 to the printheads. Moving the wiper blades 122, 124 on the carriage assembly to align with the staggered printheads reduces the amount of travel required of the printheads, and results in a smaller and more cost effective printhead cleaning apparatus 100. The reduced printhead travel also reduces the fatigue failure of the electronics, cables and ink umbilicals that are attached to the printheads.

Furthermore, the printhead cleaning apparatus 100 as such is insensitive to where the wiper blade carriage assembly 110 is located at the beginning of the maintenance or cleaning cycle, because it can always be moved independently where it aught to be. The printhead cleaning apparatus 100 also has a relatively large tolerance for alignment of the wiper blade carriage 126 to the wiper translation cable apparatus 150. In addition, the vertical motion timing belts 132, 134 are each capable of self-correction via the active tensioners T1, T2, if there is side-to-side tooth misalignment. For example, if one of the ends of the wiper blade carriage assembly 110 is undesirably run into the very bottom of the tracks 160, 162, the offending belt 132, 134 (rear or front) will skip teeth until both belts are again aligned.

During the wiping action on the upper, first set 102 of the printheads 34, 38, the front surfaces F4, F8 of the upper printheads are in a vertical orientation within the first wiping position WP1. During the wiping action on the lower, second set 104 of the printheads 32, 36, the lower printheads are tilted back about minus 9° off of vertical within the second wiping position WP2. The tracks and the wiper carriage assembly 110 are designed so that the wipers blades 122, 124 contact the front surfaces of the printheads only during the downward travel of the wiper blade carriage assembly 110, 110" so that the wipe of the printheads is executed in a very clean and controlled manner, thus eliminating any wiper blade skipping or chatter on the faces of the printheads. Wiping only in the downward travel direction also ensures that the waste ink is wiped downward towards a collector which directs the waste ink towards a waste tray.

The wiper blade carriage assembly 110 could first move the wiper blades 122, 124 to a wipe start position at the top of the wiping position WP1, WP2 and stop, followed by the printheads being purged, and then moved into contact with the wipers blades at such start of wipe position. With the printheads in a position that allows wiper blade contact ("wipe" orientation) as above, the wiper blade carriage assembly could also move so that the wiper blades 122, 124 move very slowly in a downward direction, wiping the waste ink towards the bottom of the printhead faces and towards the collector. When the wiper blades 122, 124 reach the bottom of the front faces of the printheads being wiped, the wiper blade carriage assembly 110, 110" is stopped. The printheads then move away from the wiper blades, and the wiper blade carriage assembly 110, 110" then is returned to the "home" position 112 without contacting the faces of the printheads.

The machine marking unit frame or chassis 105 includes a first portion or plate 106 (formed of plastic material) and a second portion 108 (also formed of plastic material) that are joined to each other by a sheet metal midwall. The main function of the chassis 105 as such is to provide support for the printheads 30, as well as for mounting locations for electronic circuit boards of the controller 80. The wiper tracks 160, 162 are molded into front edges of the plastic side plates 106, 108 as shown, and perform the function of retaining and positioning the wiper blade carriage assembly 110, 110" and the wiper blades thereon.

The method of the present disclosure thus includes (a) horizontally moving and aligning the wiper blade unit 120 at a first set point L1, on the upper and lower shafts 113, 114 of the wiper blade carriage assembly (WBCA) 110, for wiping the upper or first set 102 of the printheads of the staggered full-width array (SFWA); (b) moving the WBCA from the home position 112 into a first dabbing position; (c) moving the first set 102 of printheads from their, first resting position RP1 into contact with the WBCA in the first dabbing position; (d) dabbing the wiper blade unit of the WBCA against the first set of printheads to clean the wiper blades 122, 124 of the wiper blade unit 120; (e) moving the first set 102 of printheads out of contact with the WBCA; (f) moving the WBCA from the first dabbing position back to the home position; (g) purging the orifices or nozzles of the first set of printheads by forcibly ejecting a desired quantity of ink from each printhead nozzle; (h) moving the first set of printheads into a WBCA contact, first wiping position WP1; (i) moving the WBCA from the home position into wiping contact with, and past, the first set of printheads in the first wiping position; (j) moving the first set of printheads out of the first wiping position and out of contact with the WBCA; (k) moving the WBCA from the first wiping position back to the home position.

The method further includes (a") horizontally moving and re-aligning the wiper blade unit 120 at a second set point L2 on the upper and lower shafts 113, 114 thus turning WBCA into WCBA", for wiping the second set 104 of printheads of the SFWA; (b") moving the WBCA" from the home position into a second dabbing position; (c") moving the second set of printheads from their, second resting position RP2 into contact with the WBCA" in the second dabbing position; (d") dabbing the wiper blade unit of the WBCA" against the second set of printheads to clean the wiper blades 122, 124; (e") moving the second set of printheads out of contact with the WBCA"; (f") moving the WBCA" from the second dabbing position back to the home position; (g") purging the second set of printheads by forcibly ejecting a desired quantity of ink from each printhead nozzle; (h") moving the second set of printheads into a WBCA" contact, second wiping position WP2; (i") moving the WBCA" from the home position into wiping contact with, and past, the second set of printheads in the second wiping position; (j") moving the second set of printheads out of the second wiping position and out of contact with the WBCA"; and (k") moving the WBCA" from the second wiping position back to the home position.

As can be seen, there has been provided a method and apparatus for cleaning a first set and a second set of a staggered full-width array printhead assembly (SFWA) in an inkjet printer. The apparatus for the method includes (a) a wiper blade carriage assembly (WBCA) having a wiper blade unit at a first set point; (b) a timing belt and a stepper motor assembly for moving the WBCA between a home position and a number of operating positions; (c) devices for moving the first and second sets of printheads between resting positions and a wiping positions; (d) computer programs for controlling movements (i) of the WBCA from the home position into wiping contact with, and past, the first and second sets of printheads in first and second wiping positions respectively, (ii) of the first and second sets of printheads out of the wiping positions, and (iii) of the WBCA from the wiping positions back to the home position; and (e) apparatus for horizontally moving and re-aligning the wiper blade unit on the WBCA at a second set point for wiping the second set of printheads.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A printhead cleaning apparatus for cleaning a staggered full-width array printhead assembly (SFWA) in an inkjet printer, the cleaning apparatus comprising:

(a) a wiper blade carriage assembly (WBCA) including an upper shaft, a lower shaft, and a wiper blade unit for wiping a first set and a second set of printheads of the SFWA, said wiper blade unit being mounted slidably on said upper and lower shafts;

(b) a timing belt drive assembly including a timing belt and a stepper motor configured to move the WBCA between a home position and a number of operating positions along substantially vertical tracks;

(c) a printhead mover configured to move said first set of printheads between a first resting position and a contact position with said wipers on said WBCA;

(d) a controller configured to purge nozzles and orifices of said first set of printheads and to control movements (i) of said WBCA from said home position into wiping contact with, and past, said first set of printheads in said first wiping position, (ii) of said first set of printheads out of said first wiping position and out of contact with said WBCA, and (iii) of said WBCA from said first wiping position back to said home position; and the controller also being configured to horizontally move and re-align said wiper blade unit on said WBCA at a second set point forming WBCA" for wiping a second set of printheads of the SFWA, to purge said second set of printheads, to move said second set of printheads between a first resting position and a contact position with said wipers on said WBCA"; and to control movements (i) of said WBCA" from said home position into wiping contact with, and past, said second set of printheads in said second wiping position; (ii) of said second set of printheads out of said second wiping position and out of contact with said WBCA"; and (ii) of said WBCA" from said second wiping position back to said home position.

2. The printhead cleaning apparatus of claim 1, wherein said wiper blade unit comprises two laterally spaced elastomeric blades.

3. The printhead cleaning apparatus of claim 2, wherein a front surface of each printhead of said first set of printheads lies on a vertical first plane within said first wiping position.

4. The printhead cleaning apparatus of claim 1, the timing belt assembly includes a pair of timing belts.

5. The printhead cleaning apparatus of claim 1, wherein a front surface of each printhead of said second set of printheads lies on a second plane inclined at minus 9 degrees from vertical within said second wiping position.

6. The printhead cleaning apparatus of claim 1, wherein the controller horizontally moves and re-aligns said wiper blade unit by operating a first paddle on said WBCA to mate with a second paddle on a movable wiper translation cable on a frame of the printer.

7. The printhead cleaning apparatus of claim 1, wherein the controller includes executable computer programs having timing and positioning data for controlling WBCA and WBCA" movements.

8. The printhead cleaning apparatus of claim 1, said WBCA includes a first stop and a second stop at a first end and a second end of said upper and lower shafts for aligning said wiper blade unit in a first set point and a second set point respectively on said WBCA.

9. A printhead cleaning apparatus for cleaning a first set and a second set of a staggered full-width array printhead assembly (SFWA) in an inkjet printer, the printhead cleaning apparatus comprising:

(a) a wiper blade carriage assembly (WBCA) having an upper shaft, a lower shaft, and a wiper blade unit located at a first set point for wiping said first set of printheads, said wiper blade unit being mounted slidably on said upper and lower shafts;

(b) a timing belt and a stepper motor assembly coupled to said WBCA for moving said WBCA between a home position and a number of operating positions;

(c) devices for moving said first set and said second set of printheads between resting positions and wiping positions;

(d) a controller executing computer programs to control movements (i) of said WBCA from said home position into wiping contact with, and past, said first set and said second set of printheads in first and second wiping positions respectively, (ii) of said first set and said second set of printheads out of said first and second wiping positions respectively, and (iii) of said WBCA from said first and second wiping positions back to said home position; and to move horizontally and realign said wiper blade unit on said WBCA at a second set point for wiping said second set of printheads.

* * * * *